US005119877A

United States Patent [19]

Sapko et al.

[11] Patent Number: 5,119,877

[45] Date of Patent: Jun. 9, 1992

[54] EXPLOSION SUPPRESSION SYSTEM

[75] Inventors: Michael J. Sapko, Finleyville; Robert A. Cortese, Pittsburgh, both of Pa.

[73] Assignee: The United States of America as represented by the Secretary of the Interior, Washington, D.C.

[21] Appl. No.: 555,211

[22] Filed: Jul. 19, 1990

[51] Int. Cl.[5] ..... A62C 37/00; A62C 35/08; A62C 3/02

[52] U.S. Cl. ..... 169/61; 169/64; 169/28; 169/58; 340/522; 340/578; 250/554

[58] Field of Search ..... 169/64, 58, 61, 56, 169/26, 28, DIG. 3; 340/522, 578, 626, 515; 250/554

[56] References Cited

U.S. PATENT DOCUMENTS

| | | | |
|---|---|---|---|
| 3,482,637 | 12/1969 | Mitchell et al. | 169/64 X |
| 3,515,217 | 6/1970 | Jamison | 169/64 X |
| 3,684,021 | 8/1972 | Poitras | 169/64 X |
| 3,831,318 | 8/1974 | Richmond | 169/64 X |
| 3,878,897 | 4/1975 | Goffart | 169/64 X |
| 4,101,887 | 7/1978 | Osborne | 169/61 X |
| 4,173,140 | 11/1979 | Liebman et al. . | |

*Primary Examiner*—Margaret A. Focarino
*Assistant Examiner*—James M. Kannofsky
*Attorney, Agent, or Firm*—E. Philip Koltos

[57] ABSTRACT

An explosion suppression system and triggering apparatus therefor are provided for quenching gas and dust explosions. An electrically actuated suppression mechanism which dispenses an extinguishing agent into the path ahead of the propagating flame is actuated by a triggering device which is light powered. This triggering device is located upstream of the propagating flame and converts light from the flame to an electrical actuation signal. A pressure arming device electrically connects the triggering device to the suppression device only when the explosion is sensed by a further characteristic thereof beside the flame such as the pioneer pressure wave. The light powered triggering device includes a solar panel which is disposed in the path of the explosion and oriented between horizontally downward and vertical. Testing mechanisms are also preferably provided to test the operation of the solar panel and detonator as well as the pressure arming mechanism.

16 Claims, 1 Drawing Sheet

EXPLOSION SUPPRESSION SYSTEM

FIELD OF THE INVENTION

The present invention relates generally to a system for quenching explosions which explosions have a flame propagating along a path, and more particularly to such a suppression system including a light powered actuating means.

BACKGROUND OF THE INVENTION

The United States Government as well as many others have been developing triggered barriers for suppressing incipient as well as fully developed gas and dust explosions in underground coal mines or other industries where combustible gases or dust accumulate. In order for such barriers to be effective, it is important that incipient explosions be detected early and the barrier unit activated so as to contain the explosions. Presently, all triggered barriers consist of three essential elements: a flame or explosion sensor, some type of a flame extinguisher dispensing system, and an effective extinguishing agent. Most triggered barriers have an optical or mechanical device to sense the developing explosion, and an electronic signal processing package to process the sensed signal and then activate the dispenser which rapidly dispenses the extinguishing agent. The extinguishant, which can be gas, liquid, powder, or some combination is discharged by some form of stored energy, such as explosive or gas pressure.

All of the known rapidly activated triggering systems require an external power source to activate the triggered barrier. In most coal mines, it is difficult to provide power to those locations where explosion protection is needed.

As appreciated by those of ordinary skill in the art, coal dust explosions are most often initiated by an electrical or frictional ignition of a pocket or layer of a flammable methane-air mixture that causes a local aerodynamic disturbance with sufficient violence to scour up, disperse, and ignite coal dust lying on the mine surfaces. If conditions are right, the resulting flame grows into a self-sustaining coal dust explosion, and can propagate for long distances in a mine. Triggered barriers are thus being used worldwide in potentially hazardous regions of mines.

A typical installation includes a sensor located in the proximity of the suspected explosion source, and an extinguishant dispersal unit located sufficiently far from the sensor to provide time for the extinguishing agent to be discharged prior to flame arrival. It has been found that maximum effectiveness of the extinguishant is attained when it is ejected rapidly and early enough to blanket the entire mine entry cross section prior to flame arrival. If the extinguishant is dumped prematurely, the extinguishant is driven downstream so that its concentration is diluted by the explosion-induced wind before being overtaken by the flame. When the trigger signal is late, the extinguishant is dumped behind the flame where it has minimal effect.

One prior art system for sensing flames or explosions and for activating triggering barriers in mines includes devices which sense directly the temperature rise of an explosion, such as a thermocouple. These devices are limited to sensing the flame at a single point in space, and may trigger late when the flame front does not fill the entire entry cross section. In order to combat poor response time, extremely fine thermocouple wires (5 micrometers) are used. However, such fine thermocouple wires are fragile and easily damaged by shocks or impacts. In addition, such thermocouples may be falsely triggered by incidental flames or heat sources from welding torches or the like Another current system for sensing flames or explosions and for activating triggering barriers in mines includes devices that detect ultraviolet, visible, infrared, or black body radiation emitted by the flame. Unfortunately, such devices can be tripped by one or more false signals generated by miners' cap lamps, illumination lights on vehicles or equipment, sparks, arcs and hot surfaces Yet another current system includes devices which respond to dynamic wind forces preceding the flame, such as wind vanes. Unfortunately, such devices are slow to respond, sensitive to shocks and impacts, and can respond falsely to a roof fall or blasting. Such systems can also fire prematurely during a dust explosion since there is little or no correlation between wind velocity and flame location.

Still another current system includes devices which fire in response to a static pressure rise Such devices have some of the same faults and disadvantages as devices which respond to wind, and thus they also respond falsely and prematurely.

Another suppression system is disclosed in U.S. Pat. No. 4,173,140 (Leibman et al). This system uses a sensor-trigger device having dual infrared flame sensors in combination with a pressure-arming unit. This combination is intended to prevent false and premature triggering. The pressure sensing element switches on battery power to fire a detonator when a static pressure rises above 0.04 atm (0.5 psi), and each flame sensor views a separate narrow vertical field and must operate in coincidence to turn on a firing relay. Each of the infrared flame sensors sights across the mine entry at a horizontal angle of about 25° apart and through a vertically oriented slit. As each sensor must also detect radiation concurrently to energize firing, this minimizes the possibility of false triggering by small radiation sources such as miners' cap lamps when located at some distance from the sensors.

SUMMARY OF THE INVENTION

In accordance with the present invention, an explosion suppression system and triggering apparatus are provided for quenching gas and dust explosions where such explosions are characterized by a flame propagating along a path. The suppression system includes an electrically actuated suppression means for dispensing an extinguishing agent into the path ahead of the propagating flame. A triggering device for the suppression means then includes a light powered triggering means located upstream along the path of the propagating flame from the suppression means. This light powered triggering means receives light from the propagating flame and converts this light to an electrical actuation signal for the suppression means.

Preferably, an arming means is provided for electrically connecting the triggering means to the suppression means only when the explosion is sensed by a further characteristic thereof beside the flame. This further characteristic is preferably a precursor pressure pulse, which is sensed by a pressure sensing means. A switch means then switches between a normally open position isolating the electrical actuation signal from the suppression means and a closed position connecting the actuation signal to the suppression means when the pressure sensing means senses the precursor pressure pulse.

The light powered triggering means includes a solar panel which generates an electrical signal from received radiation having a wavelength of 0.3 to 1.1 microns. Further, the solar panel has a collection face which is disposed in the path so as to be facing between horizontally downward and vertical.

The triggering means also includes a testing means for indicating that the triggering means is converting light to an electrical signal when a test light source is received by the triggering means Preferably, the testing means also indicates that the switching means is switched to the closed position when a test pressure is applied to the pressure sensing means and a test light is received by the triggering means.

It is an advantage of the present invention that the triggering apparatus is very sensitive and fast, allowing the suppression system to be placed close to a potential ignition source where pressures are low and there is very little time separation between the pressure wave and the arrival of the flame at a suppression means.

It is also an advantage of the present invention that the triggering apparatus uses flame radiation to power detonators of the suppression system so that an external battery or power supply is unnecessary and the suppression system itself is maintenance free.

It is also a further advantage of the present invention that the suppression system is usable for both gas and dust explosions.

Still a further advantage of the present invention is that the suppression system has the capability of detecting flames propagating at over 1,000 feet per second and for explosively dispersing an extinguishing agent into the advancing flame within 50 to 100 milliseconds.

DETAILED DESCRIPTION OF THE PREFERRED EMBODIMENTS

Figure 1:
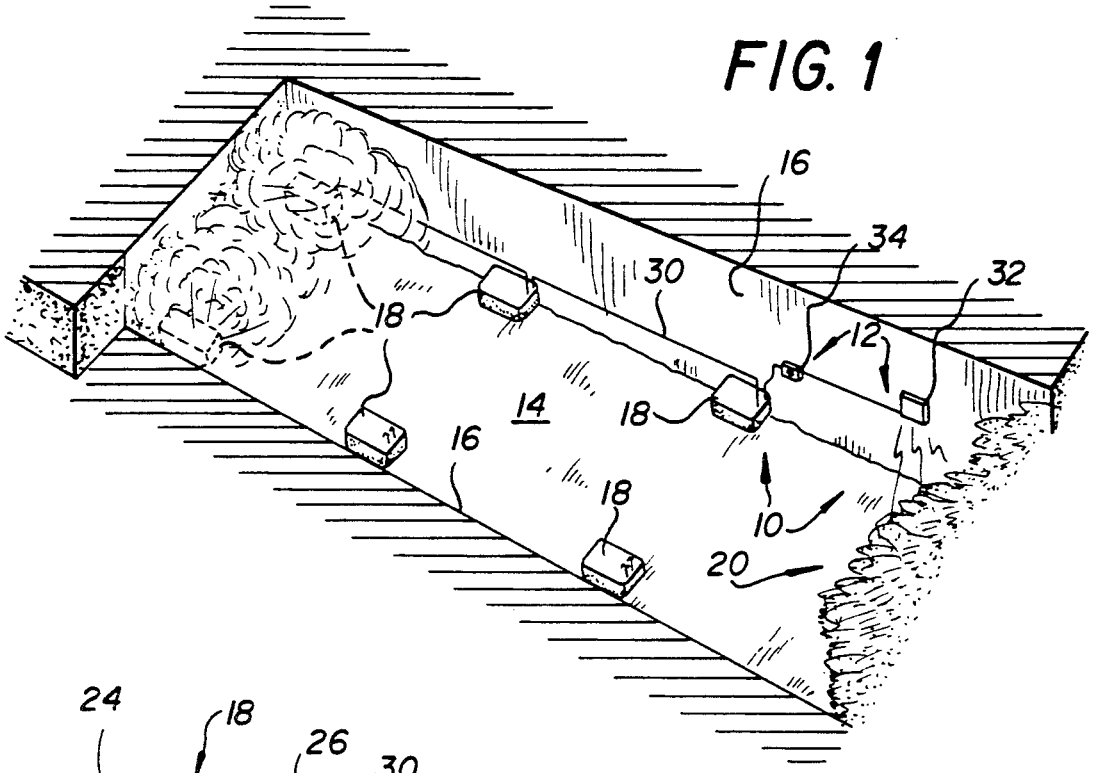
FIG. 1 is a schematic cut-away perspective view of the suppression system according to the present invention in operation in a mine gallery.

With reference now to the drawings in which like numerals represent like elements throughout the several views, a self-contained suppression system 10 having a triggering device 12 according to the present invention is schematically depicted in FIG. 1. Suppression system 10 is disposed in a mine gallery 14 adjacent a rib 16 thereof. Suppression system 10 includes extinguishing units 18, two of which are shown with the extinguishing agent dispersed into gallery 14 in response to an explosion having a flame 20 propagating along gallery 14 toward extinguishing units 18.

Figure 2:
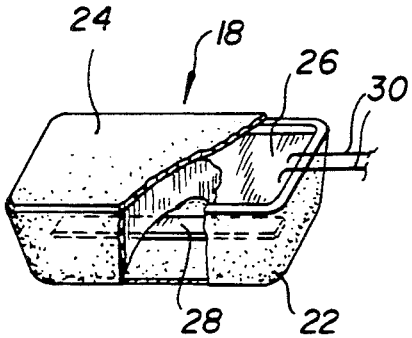
FIG. 2 is a schematic cut-away perspective view of an extinguishing unit depicted in FIG. 1.

Depicted in FIG. 2 is an extinguishing unit 18. Extinguishing unit 18 includes a rigid foam container 22 having a lid 24. Provided in container 22 is an extinguishing agent 26. At the bottom of foam container 22 is a sheet explosive 28 connected to detonator wires 30. When detonated, sheet explosive 28 disperses extinguishing agent 26 into the surrounding area. As shown in FIG. 1, pairs of such extinguishing units 18 are provided across from one another in mine gallery 14 so that any two such units will effectively fill the entire cross-sectional area of mine gallery 14 when exploded simultaneously.

Triggering device 12 of the present invention is particularly adapted to make use of two unique characteristics of gas and dust explosions. Experiments at the U.S. Bureau of Mines have shown that during a self-sustaining dust explosion, a static pressurize exceeding 0.1 atm always precedes a propagating flame. The time between the arrival of such a pioneer or precursor pressure wave or pulse and the following propagating flame ranges from a fraction of a second to one second or even more. Utilizing these characteristics of gas and dust explosions, triggering device 12 includes a light powered triggering means 32 and a pressure arming means 34.

Figure 3:
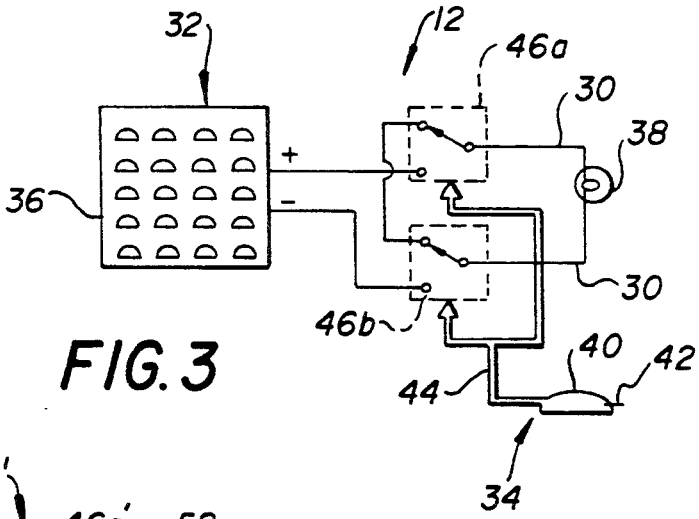
FIG. 3 is a schematic diagram of a triggering device according to the present invention.

As shown in FIG. 3, light powered triggering means 32 is conveniently simply a solar panel 36, such as a SOLEC M-1136-3 Marine 20 W Module. Solar panel 36 measures 23.5 cm by 59.7 cm, and consists of 36 silicon cells each configured as a semi-circle with a diameter of 10.16 cm. In use during an explosion situation, solar panel 36 collects 0.3 micron to 1.1 micron wavelength radiation from propagating flame 20 and then generates electrical energy to initiate a detonator 38 for each extinguishing unit 18.

Where multiple detonators are used, it should be appreciated that a parallel configuration must be employed to ensure that all detonators are fired. The orientation of a load line is thus determined by the number of detonators connected in parallel and the internal resistance of each detonator.

It has been found that solar panels such as solar panel 36 which are rated to produce 20 W of electrical power when exposed to sunlight produce about 200 W when exposed to a full-scale dust explosion and flame thereof. It should also be appreciated that the resulting electrical power is directly proportional to incident radiation power. It has also been found that the electrical solar output power of solar panel 36 is present for a period of 0.25 to 1.0 second ahead of flame 20.

Solar panel 36 is electrically isolated from detonator 38 by pressure arming means 34. Pressure arming means 34 includes a bellows 40, such as one made by Pres-Air-Trol Corporation No. 6448. Bellows 40 includes a pressure balancing needle 42 to balance the pressure in bellows 40 during slow ambient changes Bellows 40 is connected by plastic tubing 44 to respective low pressure switches **46*a* and 46*b*. As shown, detonator 38 is connected to low pressure switches 46 so that detonator 38 is ordinarily shunted. However, where bellows 40 experiences a pressure rise, detonator 38 is switched so as to be directly connected to solar panel 36**.

In operation, triggering device 12 functions in the following manner. In the event of an explosion, the pressure wave proceeding propagating flame 20 depresses bellows 40. The depression of bellows 40 activates low pressure switches **46*a* and 46*b*, removing the shunt from detonator 38 and connecting detonator 38 to solar panel 36. Then, as propagating flame 20 approaches and fills the field of view of solar panel 36, solar panel 36 converts the radiation from flame 20 to an electrical activation signal causing detonator 38 to be detonated and extinguish agent 26 to fill mine gallery 14 and thus to extinguish flame 20**.

Explosion tests have been conducted using the present invention Two solar panels 36 were mounted on ribs looking across an entry, one located 50 feet from the face and another at 157 feet from the face. A dusted zone started at 40 feet and was scoured from the dusted surface and carried out by the preceding pressure wave so that the 50 foot solar panel saw a gas explosion. The other panel, therefore, saw a dust explosion.

The dust explosion was initiated with a gas explosion. The flame propagated through the dust cloud at an average speed of 750 feet per second, which is typical of a moderate strength explosion with the flame lagging about 0.5 seconds behind the pioneer wave at 300 feet from the closed end. About 10 msec after flame arrival, the detonators which were electrical blasting caps detonated to cause the rapid release of the extinguishing agent into the advancing flame. The more violet dust explosion produced higher flame temperatures, and therefore a shorter time separation between the pioneer pressure wave and the flame. In a weak explosion, it was expected that the flame would lag several seconds behind the pioneer wave, resulting in a longer time interval between pressure switch arming and flame arrival.

Research has also shown that the temperature of a coal dust flame ranges from about 1400° to 1900° K, and the flame radiant spectrum is approximated by a black body continuum. By integrating a black body continuum for a given temperature over wavelength for the active region of solar panel 36, the radiative input power to solar panel 36 is determined. Then, utilizing the approximate solar panel conversion efficiency, the ratio of inductive input power to electrical output is computed. Since solar panel 36 has an active region of approximately 0.146 $m^2$ it was calculated that solar panel 36 would produce approximately 200 electrical watts for an 1800° K dust explosion. Thus, it was determined that this would be more than sufficient to power a suitable one watt detonator 38.

Although gas flames have a slightly higher temperature than dust flames, they are not as optically thick as dust flames because the radiated energy is emitted in discrete $H_2O$ and $CO_2$ bands. Thus, it was determined that the net radiative output power from gas explosions is still sufficient to firing detonator 38 with solar panel 36. Furthermore, the presence of small amounts of a solid contaminant, such as dust particles, in a gas flame significantly enhances the radiative power output by increasing the optical thickness of the gas flame.

Figure 4:
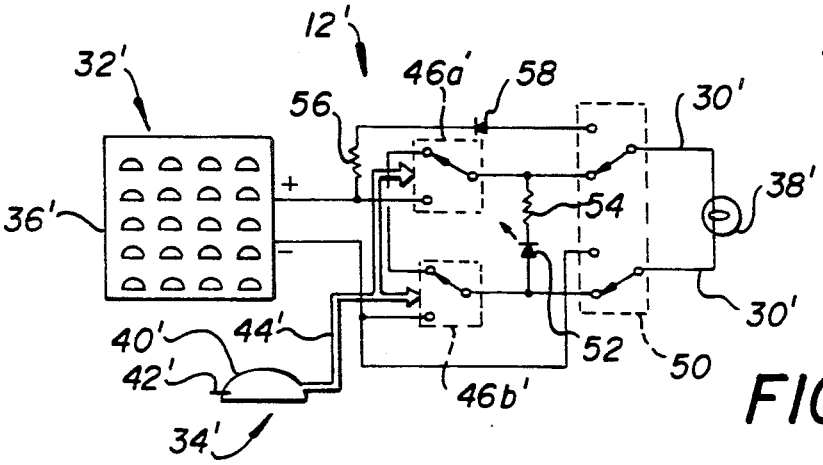
FIG. 4 is a schematic diagram of an alternative embodiment of a triggering device according to the present invention.

Depicted in FIG. 4 is a modified embodiment of a triggering device 12'. Triggering device 12' is similar to triggering device 12 discussed above, so that the same elements of triggering device 12' are identified with the same numerals as in triggering 12, but with the addition of a "'". Triggering device 12' includes additional circuitry for component testing. In particular, a water and air tight momentary push button test switch 50 is provided which is connected between detonator 38' and low pressure switches **46*a'* and 46*b'*. A suitable switch is C&K/UNIMAX TH72-132 or an equivalent. Bridging the two contacts of the switch is a light emitting diode 52 and a 1,000 ohm ½ watt resistor 54. Solar panel 36' is also directly connected to test switch 50 through a 1,000 ohm ⅛ watt resistor 56 and a light emitting diode 58**.

In operation, trigger device 12' functions in the same manner as trigger device 12 described above. However, trigger device 12' has the capability to verify the integrity of solar panel 36' and detonator 38'. This is accomplished by depressing test switch 50 and illuminating solar panel 36' by a suitable light source such as a cap lamp. If everything is functioning properly, light emitting diode 58 will be illuminated. However, it should be appreciated that the output of solar panel 36' which passes through resistor 56 is not sufficient to cause detonation of detonator 38'.

To verify the operation of bellows 40', pressure switches **46*a'* and 46*b'*, and solar panel 36', bellows 40' is depressed and solar panel 36' is illuminated by a suitable light source. If all of these elements are functioning correctly and in particular pressure switches are 46*a'* and 46*b'*, light emitting diode 52** is illuminated.

It should be appreciated that the present invention provides a flame powered photogenerator or light powered triggering means so that no external power supply is required This light powered generating means is then combined with a pressure arming means in order to prevent false activation. This combination of light powered generating means and pressure arming means is very fast acting. This allows suppression activities to take place closer to an ignition source where pressures are low and there is very little time separation between the pioneer pressure wave and the arrival of the flame at the suppression system.

In view of the dustiness of underground coal mines, there has been some concern that solar panels 36 or 36' might be coated with sufficient dust to obstruct the flame radiation from reaching the solar cells. Tests have been conducted to measure the output voltage of a solar panel when irradiated with a high intensity incandescent lamp with various amounts of dust sprinkled over the surface of the solar panel. Results show that a coal dust loading of 5 $mg/cm^2$ is required to reduce the output from a typical 100 W explosion below the 1 W necessary to fire the detonator. Rock dust, being translucent, does not obstruct the radiated light as effectively as opaque coal dust. Thus, approximately 5 times as much rock dust as coal dust is required to be accumulated before the output of solar panel 36 is reduced below 1 W.

It should also be appreciated that the tested dust loadings were for a worst case, horizontal collection surface. It is specifically recommended that in typical mine installations, solar panel 36 or 36' would be either vertically mounted on a rib or upside down on a mine roof, or at some angle therebetween. In both the vertical and upside down orientations, the attracted or adhered dust would be expected to be less than 1 $mg/cm^2$ so that minimal reduction in output power would be experienced.

While the coating of solar panel 36 or 36' with oil or water might also be expected, experiments also showed that these substances slightly magnified the output of solar panel 36 or 36' (with oil having the greater effect). It should also be appreciated that even where some accumulation of dust is present on the solar panel, with the solar panel mounted vertical the wind of the explosion would be expected to cleanse the windows to some extent. Thus, in actual situations, it is not expected that there will be much of a measurable difference in output between a solar panel which has been coated or uncoated.

Although the present invention has been described with respect to use in a mine such as a coal mine or the like, it should be appreciated that with modifications trigger device 12 or 12' can be used to activate fire suppression systems on underground conveyor belts, refueling equipment, load centers, and remote areas susceptible to rapid fire growth. Trigger device 12 or 12', along with a portable explosion suppression system, can also be used by rescue teams during mine recovery operations where secondary explosions are a threat.

The entire suppression system also has application in industrial operations involving the production and processing of flammable dust. These other operations include metal processing plants, oil shale, and sulfide ore mines, coal pulverizes, and grain elevators.

Thus, while the present invention has been described with respect to exemplary embodiments thereof, it will be understood by those of ordinary skill in the art that variations and modifications can be effected within the scope and spirit of the invention.

We claim:

1. A suppression system for quenching gas and dust explosions, which suppression system is electrically powered solely by light radiated by a characteristic flame of an explosion propagating along a path adjacent to said system, said system comprising:

an electrically actuated suppression means for dispensing an extinguishing agent into the path ahead of the propagating flame when actuated by an electrical energy; and a triggering device for supplying said suppression means with the electrical energy for activation only when the flame of the explosion is propagating along a path adjacent thereto, said triggering device including a light powered triggering means located upstream along the path of the propagating flame from said suppression means for converting light radiated by the propagating flame to the electrical energy which directly powers said suppression means.

2. A suppression system as claimed in claim 1 and further including an arming means for electrically connecting the energy produced by said triggering means to said suppression means only when the explosion is sensed by a further characteristic thereof beside the flame.

3. A suppression system as claimed in claim 2 wherein said triggering means includes a testing means for indicating that said triggering means is converting light to electrical energy when a test light is received by said triggering means, said testing means including an electrical indicator which is powered by electrical energy converted from the test light received by said solar panel.

4. A suppression system as claimed inn claim 3 wherein said arming means includes a pressure sensing means for sensing precursor pressure pulse characteristic of the propagating flame and a switch means for switching between a normally open position isolating said triggering means from said suppression means and a closed position connecting said triggering means to said suppression means when said pressure sensing means senses the precursored pressure pulse.

5. A suppression system as claimed in claim 4 wherein said testing means is also for indicating that said switching means is switched to the closed position when a test pressure is applied to said pressure sensing means and a test light is received by said triggering means.

6. A suppression system as claimed in claim 2 wherein said arming means includes a pressure sensing means for sensing a pecursor pressure pulse characteristic of the propagating flame and a switch means for switching between a normally open position isolating the electrical energy produced by said triggering means from said suppression means and a closed position connecting the electrical energy produced by said triggering means to said suppression means when said pressure sensing means senses the precursor pressure pulse.

7. A suppression system as claimed in claim 6 wherein said pressure sensing means is spaced downstream along the direction of flame propagation from said light powered triggering means.

8. A suppression system as claimed in claim 6 wherein said light powered triggering means includes a solar panel which generates an electrical energy from received radiation having a wavelength of 0.3 to 1.1 microns.

9. A suppression system as claimed in claim 8 wherein said solar panel includes a collection face disposed in the path so as to be facing between horizontally downward and vertical.

10. A suppression system as claimed in claim 9 wherein said triggering means includes a testing means for indicating that said triggering means is converting light to electrical energy when a test light is received by said solar panel, said testing means including an electrical indicator which is powered by electrical energy converted from the test light received by said solar panel.

11. A suppression system as claimed in claim 10 wherein said testing means is also for indicating that said switching means is switched to the closed position when a test pressure is applied to said pressure sensing means and a test light is received by said solar panel.

12. A triggering apparatus for electrically powering a detonator of a suppression system when a propagating explosion including a flame is present comprising:

a light powered triggering means which is disposed to receive light from the flame for directly converting the light received from the explosion flame to an electrical energy which powers the detonator; and a pressure arming means for detecting a sudden pressure increase and for passing the electrical energy of said triggering means to the detonator only when a sudden pressure increase is detected.

13. An apparatus for powering a suppression system as claimed in claim 12 wherein said light powered triggering means includes a solar panel which generates electrical energy from received radiation having a wavelength of 0.3 to 1.1 microns.

14. An apparatus for powering a suppression system as claimed in claim 13 wherein said solar panel includes a collection face disposed in the path so as to be facing between horizontally downwards and vertical.

15. An apparatus for powering a suppression system as claimed in claim 12 wherein said triggering means includes a testing means for indicating that said triggering means is converting light to electrical energy when a test light is received by said triggering means, said testing means including an electrical indicator which is powered by electrical energy converted from the test light received by said solar panel.

16. An apparatus for powering a suppression system as claimed in claim 15 wherein said testing means is also for indicating that said pressure arming means is passing the electrical energy produced by the test light source to the detonator only when a test pressure is applied to said pressure arming means.

* * * * *